US005376519A

United States Patent [19]

Merkel et al.

[11] Patent Number: 5,376,519

[45] Date of Patent: * Dec. 27, 1994

[54] PHOTOGRAPHIC MATERIAL CONTAINING A COUPLER COMPOSITION COMPRISING MAGENTA COUPLER, PHENOLIC SOLVENT, AND AT LEAST ONE ANILINE OR AMINE

[75] Inventors: Paul B. Merkel, Rochester; Stephen P. Singer, Spencerport, both of N.Y.

[73] Assignee: Eastman Kodak Company, Rochester, N.Y.

[ * ] Notice: The portion of the term of this patent subsequent to Apr. 6, 2010 has been disclaimed.

[21] Appl. No.: 872,940

[22] Filed: Apr. 23, 1992

[51] Int. Cl.[5] ..... G03C 1/08; G03C 7/26; G03C 7/32

[52] U.S. Cl. ..... 430/546; 430/555; 430/551; 430/372; 430/387; 430/544; 430/957

[58] Field of Search ..... 430/551, 546, 372, 387, 430/957, 555, 544

[56] References Cited

U.S. PATENT DOCUMENTS

| | | | |
|---|---|---|---|
| 4,483,918 | 11/1984 | Sakai et al. | 430/372 |
| 4,555,479 | 11/1985 | Sakai et al. | 430/372 |
| 4,585,728 | 4/1986 | Furutachi et al. | 430/372 |
| 4,853,319 | 8/1989 | Krishnamurthy et al. | 430/387 |
| 4,857,449 | 8/1989 | Ogawa et al. | 430/546 |
| 4,942,116 | 7/1990 | Renner | 430/551 |
| 4,952,487 | 8/1990 | Renner et al. | 430/546 |
| 4,965,179 | 10/1990 | Kuwashima et al. | 430/546 |
| 5,200,309 | 4/1993 | Merkel et al. | 430/555 |

*Primary Examiner*—Charles L. Bowers, Jr.
*Assistant Examiner*—Geraldine Letscher
*Attorney, Agent, or Firm*—Arthur E. Kluegel

[57] ABSTRACT

A color photographic material and process provide a two-equivalent 3-anilino pyrazolone magenta dye-forming coupler, a phenolic coupler solvent and at least one amine compound.

39 Claims, No Drawings

PHOTOGRAPHIC MATERIAL CONTAINING A COUPLER COMPOSITION COMPRISING MAGENTA COUPLER, PHENOLIC SOLVENT, AND AT LEAST ONE ANILINE OR AMINE

BACKGROUND OF THE INVENTION

The present invention relates to color photographic materials and processes employing two-equivalent pyrazolone magenta dye-forming couplers. More particularly, the invention relates to such materials and processes wherein the two-equivalent pyrazolone magenta dye-forming coupler is used in combination with a ballasted phenolic solvent compound and a ballasted aniline or amine compound.

Color photographic materials employing two-equivalent 3-anilino pyrazolone magenta dye-forming couplers are known in the art as demonstrated, for example, by U.S. Pat. No. 4,853,319 and citing therein. Two-equivalent pyrazolone magenta couplers are advantageous for use in color photographic materials owing to their low cost, high efficiency, good activity, adjustable hue and suitability for use in processes without formaldehyde.

It is also known to use phenolic solvents with 3-anilino pyrazolone couplers to shift the absorption spectra bathochromically, e.g. Renner et al U.S. Pat. No. 4,952,487. The phenolic solvents may be classified as hydrogen bond donors because of their ability to supply a hydrogen bond. Such materials have been unsatisfactory from the standpoint of continued coupling which causes a non-imagewise stain.

It is also well known in the color photographic art that couplers are used in combination with solvents and other addenda which facilitate their incorporation in the photographic materials and/or improve one or more properties of the dyes formed from the couplers. For example, the Ogawa et al. U.S. Pat. No. 4,857,449 discloses combinations of couplers and one or more high boiling organic solvents for use in color photographic materials.

It has been found that the use of conventional coupler solvents such as tricresyl phosphate provide a coupler system that exhibits poor inhibition sensitivity. In other words, the copresence of development inhibitors which are either (1) unintentionally present (e.g. as the result of side reactions) or (2) intentionally added to improve image quality, have a much greater adverse effect on the coupler reactivity than is desired and can result in unacceptable degradation of other image qualities such as grain.

U.S. Pat. No. 4,483,918 Sakai et al and Furutachi et al U.S. Pat. No. 4,585,728 and Sakai et al U.S. Pat. No. 4,555,479 disclose the use of amine (including aniline) addenda with two-equivalent pyrazolone magenta couplers to reduce stain that occurs in development processing. This problem is believed to result from the fact that two-equivalent pyrazoione magenta dye-forming couplers have low pKa values. The pKa value is $-\log Ka$, wherein Ka is the acid dissociation constant. Since these couplers tend to have low pKa values, they may be significantly ionized when films or papers coated with them are placed in solutions of low pH, i.e., a pH of 5–6, or less. Thus, when photographic materials containing these low pKa couplers are used in a process which does not employ a stop bath between the development and bleach steps, non-imagewise dye formation occurs owing to coupling with developer that is carried over into the bleach solution and oxidized therein. This phenomenon, which is referred to as continued coupling, produces undesirable increases in background density (Dmin). Continued coupling also leads to unacceptable density variability in processed films owing to variations in bleach pH as the bleach solutions become "seasoned" by continued use. Accordingly, photographic films and papers containing low pKa couplers such as the two-equivalent 3-anilino pyrazolone couplers often exhibit continued coupling because the couplers are more highly ionized at low pH and thus readily react with oxidized developer in the low pH bleach solutions. The amine materials identified by these patents are classified as hydrogen bond acceptors due to their ability to accept a hydrogen bond.

Thus, there is a need to provide color photographic materials which contain two-equivalent 3-anilino pyrazolone magenta dye-forming couplers which exhibit a reduction in the continued coupling phenomenon and which exhibit an improved inhibition sensitivity.

The achievement of satisfactory image reproduction is the result of balancing many competing factors. To maximize the saturation of individual colors it is desired to have a steeper $\gamma$ or contrast, but it is necessary to also have good sharpness, color purity, and low granularity. Developer inhibitor releasing couplers (DIR's)are associated with a silver halide layer to improve the sharpness and color purity, but DIR's tend to increase granularity and reduce contrast below that required for the film. Consequently, additional silver emulsion laydown would be necessary to reestablish the desired granularity and contrast. Further increases in both DIR content and emulsion laydown can be made in order to effect further improvements in sharpness and color purity, but eventually a point is reached where no more silver can be added because the image coupler is unable to react sufficiently and density no longer increases over the entire exposure range (loss of latitude). The point at which the loss of latitude occurs is a function of how much the DIR inhibits the development. The use of the phenol solvent of the present invention enables one to increase the level of DIR used to a much greater extent before loss of latitude is realized. The coupler system has less inhibition sensitivity. Sharper colors of purer color and less grain are thus obtainable than heretofore.

Accordingly, it is desired to provide improved color photographic materials and methods which employ two-equivalent 3-anilino pyrazolone magenta dye-forming couplers. It is further desired to provide color photographic materials and methods which employ two-equivalent pyrazolone magenta dye-forming couplers and which exhibit improved photographic properties such as a reduction in the continued coupling of the magenta dye-forming coupler during the bleach step of a color photographic process and also an improved inhibition sensitivity.

SUMMARY OF THE INVENTION

It has now been found that the materials and process of the present invention can provide improved photographic properties. The color photographic materials of the invention comprise a support bearing a silver halide emulsion and coupler composition comprising a two-equivalent 3-anilino pyrazolone magenta dye-forming coupler, a phenolic solvent compound, and at least one compound selected from anilines and amines. The phenolic compound and the aniline or amine compound in combination reduce the continued coupling phenomenon exhibited by the magenta dye-forming coupler, while at the same time improving the inhibition sensitivity of the magenta coupler. This result was not predicted because it was thought that the hydrogen bond donating phenol would neutralize the effect of the hydrogen bond accepting amine, (much like the neutralization between an acid and base) thereby destroying the beneficial effects of the components. Thus, the color photographic materials according to the present invention provide images exhibiting contrast similar to that obtained using conventional coupler solvents while substantially reducing undesirably high Dmin values and Dmin variability which are an indication of the continued coupling phenomenon while at the same time producing images of superior sharpness, grain and color reproduction due to the coupler system's ability to accept the presence of greater quantities of inhibitor without unacceptable loss in contrast.

DETAILED DESCRIPTION

The color photographic materials according to the present invention comprise a support bearing a silver halide emulsion and a coupler composition. The coupler composition comprises a two-equivalent 3-anilino pyrazolone magenta dye-forming coupler, a phenolic coupler solvent compound and at least one compound selected from the group consisting of anilines and amines.

The coupler compositions employed in the present invention include a two-equivalent 3 anilino pyrazolone magenta dye-forming coupler. The two-equivalent pyrazolone magenta dye-forming coupler included in the coupler compositions of the present invention is of the formula:

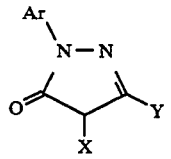

(I)

wherein:

Ar is an aryl group or pyridyl group, the substituents of either being selected from halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl, acyl, and trifluoromethyl groups;

Y is an anilino group substituted with one or more substituents selected from halogen, alkyl, aryl, alkoxy, aryloxy, carbonamido, carbamoyl, sulfonamido, sulfamoyl, alkylsulfoxyl, arylsulfoxyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, and groups which form a link to a polymeric chain, and where Y contains at least 6 carbon atoms; and X is coupling-off group selected from halogen, alkoxy, aryloxy, alkylthio, arylthio, acyloxy, sulfonamido, sulfonyloxy, carbonamido, arylazo, nitrogen-containing heterocyclic and imido groups.

Coupling-off groups are well known to those skilled in the photographic art. Generally, such groups determine the equivalency of the coupler and modify the reactivity of the coupler. Coupling-off groups can also advantageously effect the layer in which the coupler is coated or other layers in the photographic material by performing, after release from the coupler, such functions as development inhibition, bleach acceleration, color correction, development acceleration and the like. Representative coupling-off groups include, as noted above, halogens (for example, chloro), alkoxy, aryloxy, alkylthio, arylthio, acyloxy, sulfonamido, carbonamido, arylazo, nitrogen-containing heterocyclic groups such as pyrazolyl and imidazolyl, and imido groups such as succinimido and hydantoinyl groups. Coupling-off groups are described in further detail in: U.S. Pat. Nos. 2,355,169; 3,227,551; 3,432,521; 3,476,563; 3,617,291; 3,880,661; 4,052,212 and 4,134,766, and in British Patent References Nos. 1,466,788; 1,531,927; 1,533,039; 2,006,755A and 2,017,704A, the disclosures of which are incorporated herein by reference.

As is well known in the photographic art, a dye-forming coupler is typically nondiffusible when incorporated in a conventional photographic element. That is, the coupler should be of such a molecular size and configuration that it will exhibit substantially no diffusion from the layer in which it is coated. To achieve this result, the total number of carbon atoms contained in Y should be at least 6. Preferably, Y contains from 6 to about 30 carbon atoms.

It is understood throughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form but also its form substituted with any substituents which do not negate the advantages of this invention. Further, the contemplated organic substituents generally have less than 30 carbon atoms and typically less than 20 atoms.

In a preferred embodiment of the two-equivalent 3-anilino pyrazolone magenta dye-forming coupler of Formula (I), Ar is of the formula:

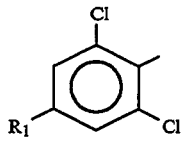

(II)

wherein R1 is selected from halogen, cyano, alkylsulfonyl, arylsulfonyl, sulfamoyl, sulfonamide, carbamoyl, carbonamido, ureido, alkoxycarbonyl, aryloxycarbonyl, acyloxy, alkoxy, aryloxy, nitro and trifluoromethyl groups.

If is further preferred that Y is of the formula:

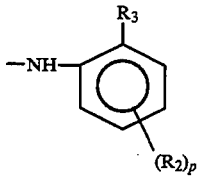

(III)

wherein p is from zero to 2 and each R2 is in a meta or para position with respect to R3;

each R2 is individually selected from halogen, alkyl, alkoxy, aryloxy, carbonamido, carbamoyl, sulfonamido, sulfamoyl, aklylsulfoxyl, arylsulfoxyl, alkylsulfonyl, arylsulfonyl, alkoxycarbonyl, aryloxycarbonyl, acyloxy, ureido, imido, carbamate, heterocyclic, cyano, nitro, acyl, trifluoromethyl, alkylthio and carboxyl groups, and;

R3 is selected from hydrogen, halogen, alkyl, alkoxy, aryloxy, alkythio, carbonamido, carbamoyl, sulfonamido, sulfamoyl, alkylsulfonyl, arylsulfonyl, alkoxycarbonyl, acyloxy, acyl, cyano, nitro and trifluoromethyl groups. Preferably, R3 is chlorine or an alkoxy group.

In a further preferred embodiment of the magenta dye-forming coupler, the coupling-off group X is of the formula:

(IV)

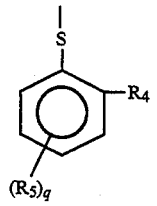

wherein R4 and R5 are individually selected from hydrogen, halogen, alkyl, alkoxy, aryloxy, carbonamido, ureido, carbamate, sulfonamido, carbamoyl, sulfamoyl, acyloxy, alkoxycarbonyl, aryloxycarbonyl, amino and carboxyl groups; and wherein q is 0, 1 or 2 and R5 may be in the meta or para position with respect to the sulfur atom. Preferably, R4 contains at least one carbon atom and R4 and R5 combined contain from about 5 to about 25 carbon atoms.

Examples of two-equivalent 3-anilino pyrazolone dye-forming magenta couplers suitable for use in the coupler compositions of the present invention include, but are not limited to the following:

M1

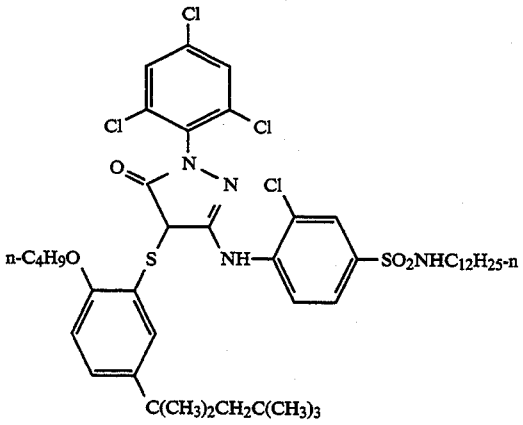

M2

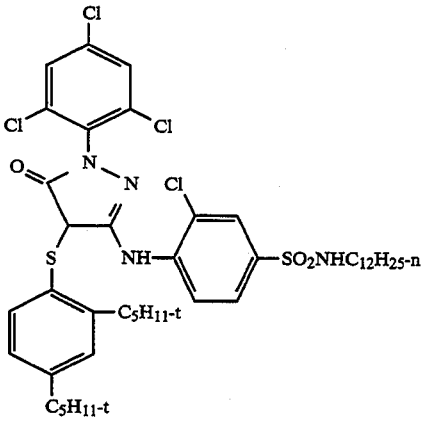

M3

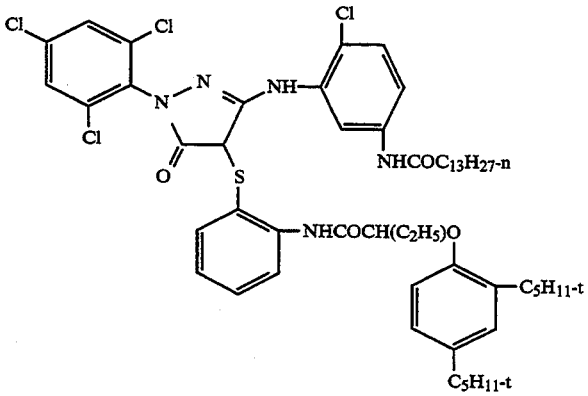

-continued
M4
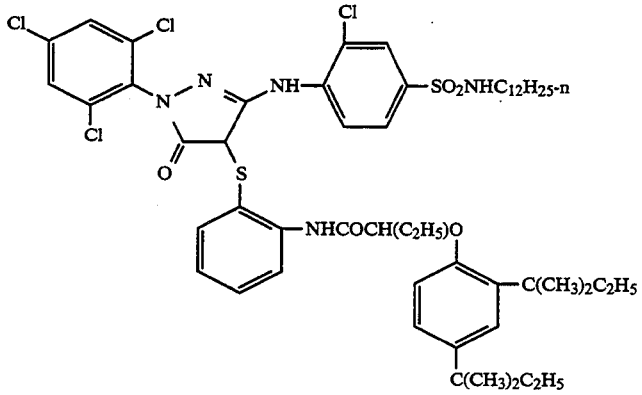
M5
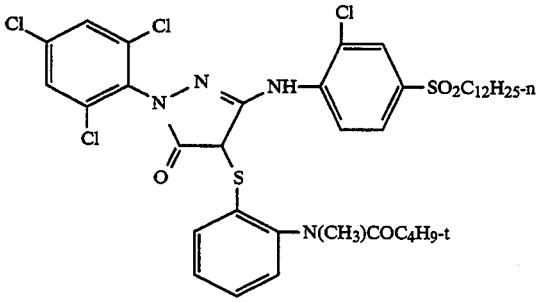
M6
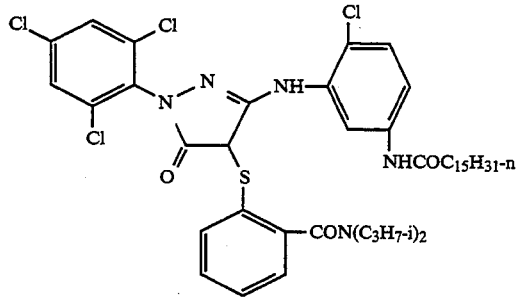
M7
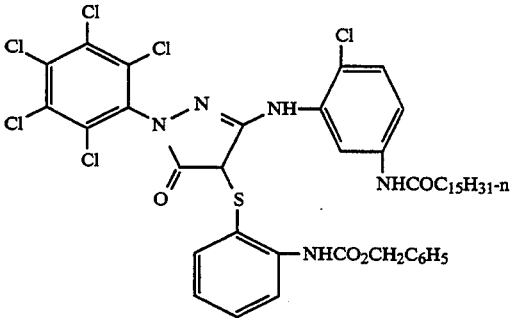
M8
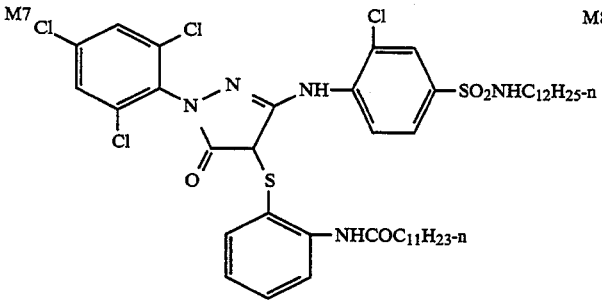
M9
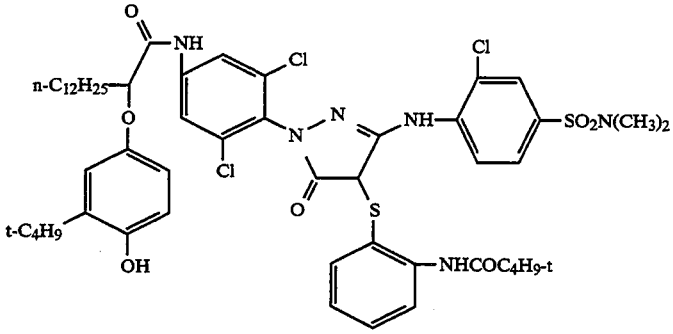

-continued
M10
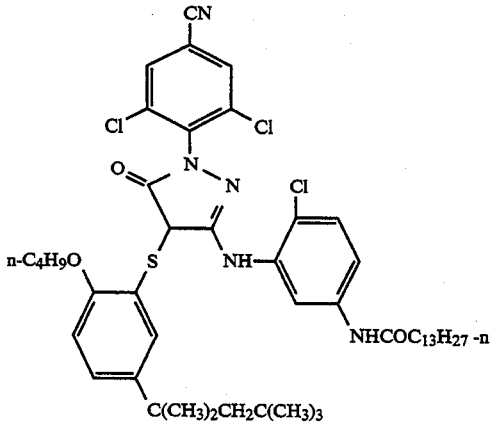
M11
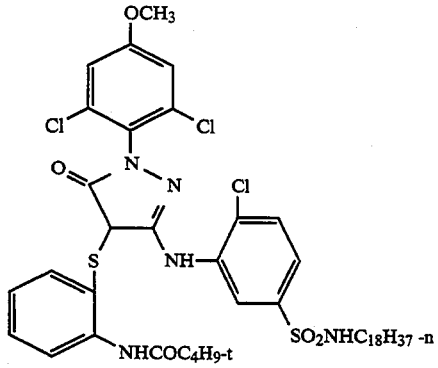
M12
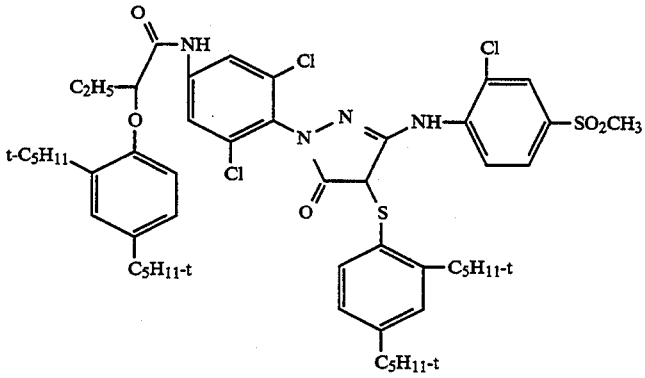
M13
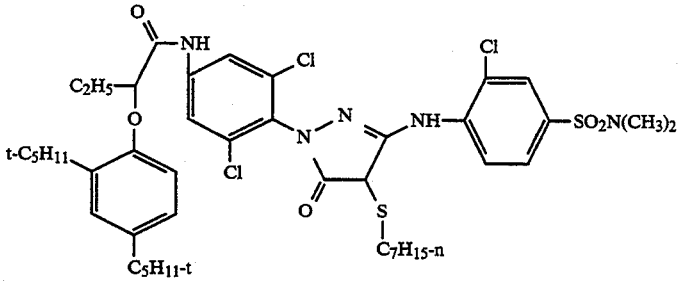
M14
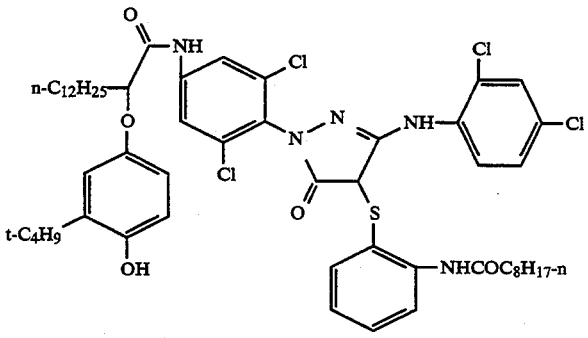

-continued

M15

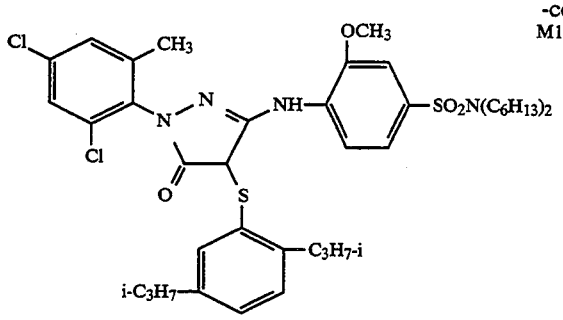

M16

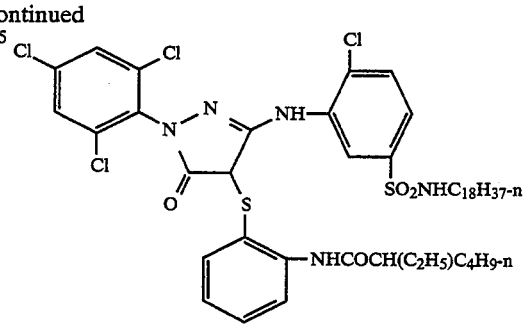

M17

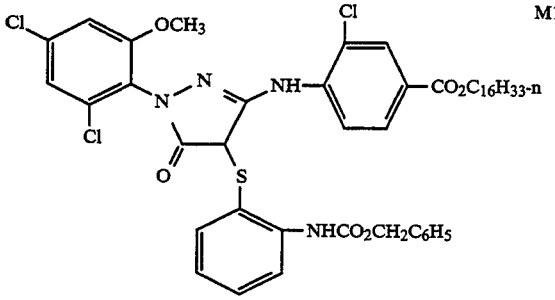

M18

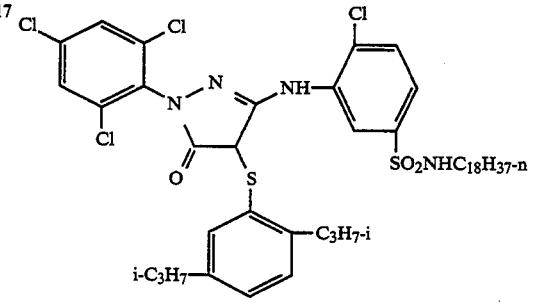

M19

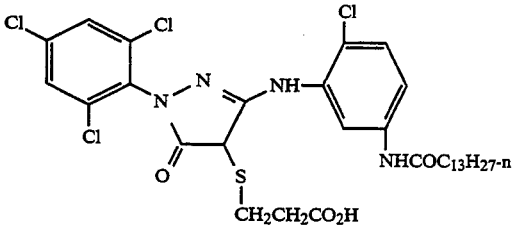

M20

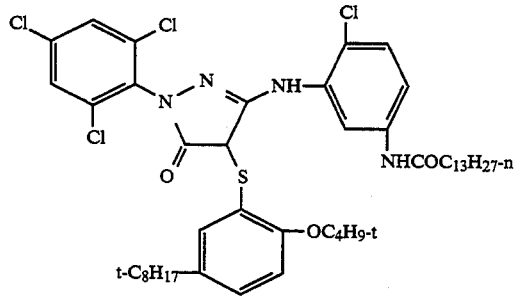

Particularly preferred two-equivalent magenta dye-forming couplers for use in the present invention include those that have pKa values of less than 10.0 when dispersed together with a coupler solvent.

The phenolic compound included in the coupler compositions of the present invention is ballasted in order to minimize volatility, water solubility and diffusivity. The compound acts as a solvent for the two-equivalent pyrazolone magenta dye-forming coupler and may be used in combination with one or more additional high-boiling cosolvents. It is preferred that the compound included in the compositions of the present invention is of the formula:

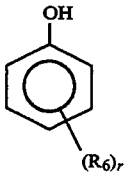

(V)

wherein, each R6 individually selected from (i) straight chain, branched and cyclic alkyl groups, (ii) straight chain branched and cyclic alkoxy groups and (iii) straight, branched chain and cyclic alkoxy carbonyl groups and wherein r is 1 to 5. Preferably the R6 groups combined contain at least 8 carbon atoms and more preferably at least 10 carbon atoms in order to have suitably low volatility, water solubility and diffusivity.

In further preferred embodiments, at least one R6 is an alkyl group, preferably an unbranched alkyl group. Most preferably, the phenol does not contain a substituent in both ortho positions.

Examples of the phenolic compounds included in the coupler compositions of the invention include, but are not limited to, the following:

C1

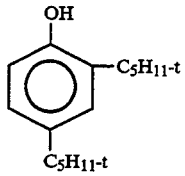

C2

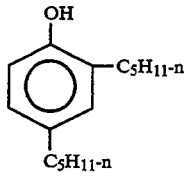

C3

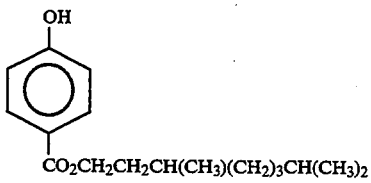

-continued

C4

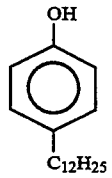

The coupler compositions which are employed in the photographic materials and methods of the present invention further include at least one compound selected from the group consisting of ballasted amines including ballasted anilines. The aniline or amine compound serves in combination with the phenolic compound and magenta coupler to reduce the continued coupling phenomenon of the two-equivalent pyrazolone magenta dye-forming coupler. Aniline compounds suitably for use in the coupler compositions of the present invention are of the following formula:

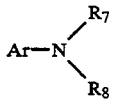

(VI)

wherein R7 is selected from the group consisting of alkyl, aralkyl, cycloalkyl and alkenyl groups and said groups including one or more substituents selected from acyloxy, alkoxycarbonyl, aryloxycarbonyl, acylamino, carbamoyl, alkoxy and aryloxy groups; R8 is selected from hydrogen and the R7 moieties; and Ar is selected from the group consisting of phenyl and phenyl including one or more substituents selected from alkyl, aralkyl, alkenyl, cycloalkyl, alkoxy, aryloxy, phenyl and acylamino groups; and wherein R7, R8 and Ar combined contain at least 12 carbon atoms. Preferably, R7, R8 and Ar combined contain from about 20 to about 40 carbon atoms. In one embodiment, R7 and R8 or R7 and Ar may be joined to form a ring.

In preferred embodiments of the aniline compounds represented by formula (VI), R7 and R8 are straight chained or branched alkyl groups and/or Ar is an alkyl or alkoxy substituted phenyl group. In a particularly preferred embodiment, Ar is a phenyl group substituted with an alkoxy group which is in a position ortho to the N atom. Additionally, the alkoxy-substituted phenyl group may include one or more additional substituents such as straight chained or branched alkyl groups.

Specific examples of aniline compounds suitable for use in the present invention include, but are not limited to, the following:

A1

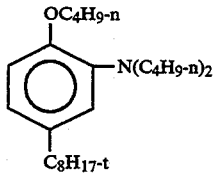

A2

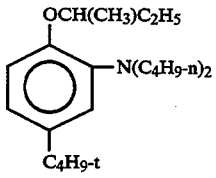

-continued

A3

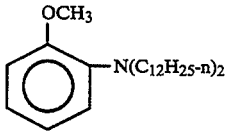

A4

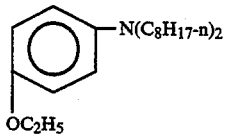

A5

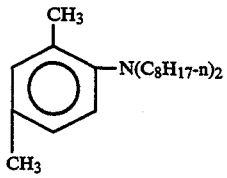

A6

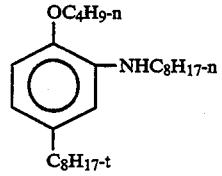

A7

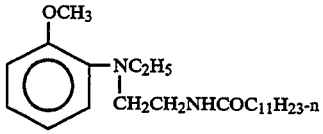

A8

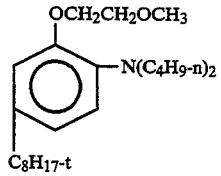

A9

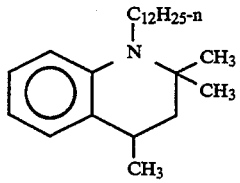

A10

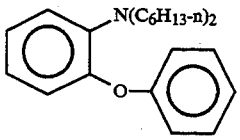

Amine compounds other than anilines which are suitable for use in the coupler compositions of the present invention are preferably of the following formula:

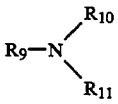

(VII)

wherein R9 is selected from the group consisting of alkyl, cycloalkyl and alkenyl groups and said groups including one or more substituents selected from halogens and alkyl, aralkyl, acyloxy, alkoxycarbonyl, aryloxycarbonyl, acylamino, carbamoyl, alkoxy, aryloxy, hydroxy, alkylsulfonyl, arylsulfonyl, alkylsufoxyl, arylsulfoxyl, phosphonyl and heterocyclic groups; and R12 and R11 are individually selected from hydrogen and the R9 moieties; and wherein R9, R10 and R11 combined contain at least 12 carbon atoms. Preferably, R9, R10 and R11 combined contained from about 15 to about 40 carbon atoms in order to minimize the volatility, water solubility and diffusivity of the amine compound. In specific embodiments, R9 and R10 or R10 and R11 may be joined form a ring. Additionally, R10, R11 and N may be joined together with an additional nitrogen atom or an oxygen atom to form a heterocyclic ring such as an imidazole ring or a morpholino ring.

Specific examples of amine compounds suitable for use in the present invention include, but are not limited to, the following:

A11

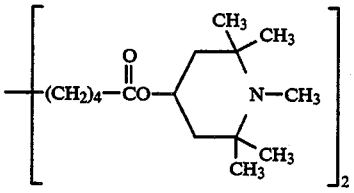

A12

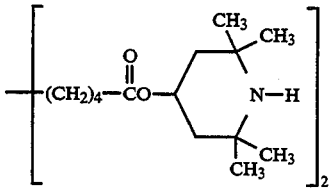

A13 $N(C_8H_{17}\text{-}n)_3$

A14 $NH(C_8H_{17}\text{-}n)_2$

A15

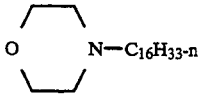

A16

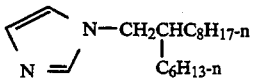

A17

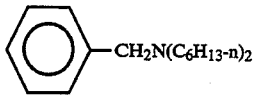

A18

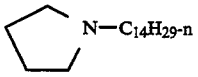

A19 $n\text{-}C_{12}H_{25}N(CH_2CH_2OCH_2CH_3)_2$

A20 $n\text{-}C_{11}H_{23}CONHCH_2CH_2N(C_6H_{13}\text{-}n)_2$

The coupler compositions according to the present invention include at least one compound selected from the anilines and amines as described above. However, it is equally within the scope of the present invention that the coupler compositions include at least one aniline compound and at least one amine compound together with the phenolic compound and the two-equivalent pyrazolone magenta dye-forming coupler.

The coupler compositions which are employed in the present invention include the phenolic compound and the aniline or amine compound in amounts suitable for providing a reduction in the continued coupling phenomenon and improved coupler inhibition sensitivity without disadvantageously affecting the photographic properties of the resulting image.

In a preferred embodiment, the 3-anilino pyrazolone magenta dye-forming coupler and the phenolic compound are included in a weight ratio of from about 1:0.1 to about 1:10. Preferably, the pyrazolone magenta dye-forming coupler and the aniline or amine compound are each employed in a weight ratio of from about 1:0.03 to about 1:3, and more preferably from about 1:0.05 to about 1:1.

As noted above, the phenolic compound acts as a solvent for the magenta dye-forming coupler. Additionally, one or more additional high-boiling organic compounds may also be employed as a cosolvent. Additional high-boiling coupler solvents that may be used in combination with the phenolic compound include aryl phosphates, for example, tricresyl phosphate; alkyl phosphates, for example, trioctyl phosphate; mixed aryl alkyl phosphates; alkyl, aryl or mixed aryl alkyl phosphonates; phosphine oxides, for example, trioctyl phosphine oxide; aromatic esters, for example, dibutyl phthalate; aliphatic esters, for example, dibutyl sebecate; alcohols, for example, 2-hexyl-1-decanol; sulfonamides; and hydrocarbons, for example, dodecylbenzene. Preferably, the phenolic solvent constitutes at least 10 wt % of the total coupler solvent and most preferably at least 50 wt %.

The coupler compositions of this invention may also include any other conventional additives.

The photographic coupler compositions according to the present invention are employed in color photographic materials in a manner well known in the photographic art. For example, a supporting substrate may be coated with a silver halide emulsion and a coupler composition of the present invention comprising a two-equivalent magenta dye-forming pyrazolone coupler, a phenolic compound and an aniline or amine compound, with the compound and the aniline or amine compound present in sufficient amounts to reduce the continued coupling during bleaching and to improve the coupler inhibition sensitivity. The photographic materials may then be imagewise exposed in a manner well known in the color photographic art, followed by development in a solution containing a primary aromatic amine developing agent. As further well known in the art, the primary aromatic amine developing agent is oxidized in an imagewise manner by reacting with exposed silver halide emulsion grains, and the oxidized developing agent reacts with the coupler to form dye.

In employing the materials and methods of the present invention, the coated photographic material containing the magenta dye-forming coupler can by removed from the developer solution and placed directly in a bleaching solution without an intervening stop bath or wash step. The purpose of the bleaching solution is to reoxidize developed silver for subsequent fixation. However, the bleaching solution also oxidizes developing agent which is carried over in the absence of an intervening stop bath or wash. In conventional materials, the oxidized developer may react with coupler to produce non-imagewise dye (Dmin), i.e., the continued coupling phenomenon. The materials of this invention minimize the continued coupling.

It is also contemplated that materials of the invention may be employed in conjunction with a photographic material where a relatively transparent film containing magnetic particles is incorporated into the material. The materials of this invention function well in such a combination and give excellent photographic results. Examples of such magnetic films are well known and are described for example in U.S. Pat. No. 4,990,276 and EP 459,349 which are incorporated herein by reference.

As disclosed in these publications, the particles can be of any type available such as ferro- and ferri-magnetic oxides, complex oxides with other metals, ferrites etc. and can assume known particulate shapes and sizes, may contain dopants, and may exhibit the pH values known in the art. The particles may be shell coated and may be applied over the range of typical laydown. The embodiment is not limited with respect to binders, hardeners, antistatic agents, dispersing agents, plasticizers, lubricants and other known additives.

Typically, the coupler is incorporated in a silver halide emulsion and the emulsion coated on a support to form part of a photographic element. Alternatively, the coupler can be incorporated at a location adjacent to the silver halide emulsion where, during development, the coupler will be in reactive association with development products such as oxidized color developing agent. Thus, as used herein, the term "associated therewith" signifies that the coupler is in the silver halide emulsion layer or in an adjacent location where, during processing, the coupler is capable of reacting with silver halide development products.

The photographic elements can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In a alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, at least one of the couplers in the element being a coupler of this invention. The element can contain additional layers, such as filter layers, interlayers, overcoat layers, subbing layers, and the like.

In the following discussion of suitable materials for use in the emulsions and elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids. plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Preferred color developing agents are p-phenylene diamines. Especially preferred are:

4-amino N,N-diethylaniline hydrochloride,
4-amino-3-methyl-N,N-diethylaniline hydrochloride,
4-amino-3-methyl-N-ethyl-N-(β-(methanesulfonamido) ethyl)aniline sesquisulfate hydrate,
4-amino-3-methyl-N-ethyl-N-(β-hydroxyethyl)aniline sulfate,
4-amino-3-β-(methanesulfonamido)ethyl-N,N-diethylaniline hydrochloride and
4-amino-N-ethyl-N-(2-methoxyethyl)-m-toluidine di-p-toluene sulfonic acid.

With negative working silver halide a negative image can be formed. Optionally positive (or reversal) image can be formed.

The magenta couplers described herein may be used in combination with other classes of magenta image couplers such as 3-acylamino-5-pyrazolones and heterocyclic couplers (e.g. pyrazoloazoles) such as those described in EP 285,274; U.S. Pat. No. 4,540,654; EP 119,860, or with other 5-pyrazolone couplers containing different ballasts or coupling-off groups such as those described in U.S. Pat. Nos. 4,301,235; 4,853,319 and 4,351,897. The coupler may also be used in association with yellow or cyan colored couplers (e.g. to adjust levels of interlayer correction) and with masking couplers such as those described in EP 213,490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The couplers may also be used in association with materials that accelerate or otherwise modify the processing steps e.g. of bleaching or fixing to improve the quality of the image. Bleach accelerators described in EP 193,389; EP 301,477; U.S. Pat. Nos. 4,163,669; 4,865,956; and 4,923,784 are particularly useful. Also contemplated is use of the coupler in association with nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The couplers may also be used in combination with filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the couplers may be blocked or coated in protected form as described, for example, in Japanese Application 61/258,249 or U.S. Pat. No. 5,019,492.

The couplers may further be used in combination with image-modifying compounds such as "Developer Inhibitor-Releasing" compounds (DIR's). DIR's useful in conjunction with the couplers of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

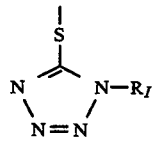

-continued

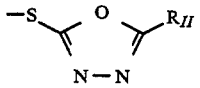

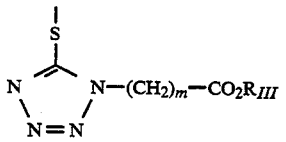

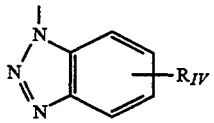

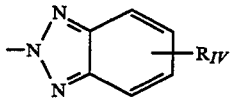

wherein $R_I$ is selected from the group consisting of straight and branched alkyls of from 1 to about 8 carbon atoms, benzyl and phenyl groups and said groups containing at least one alkoxy substituent; $R_{II}$ is selected from $R_I$ and $—SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, $—COOR_V$ and $—NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. Nos. 4,438,193; 4,618,571) and groups that combine the features describe above. It is typical that the timing group or moiety is of one of the formulas:

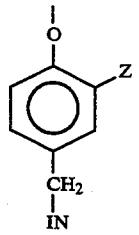

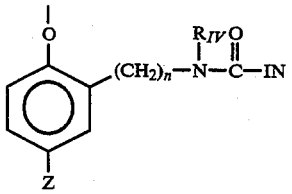

wherein IN is the inhibitor moiety, Z is selected from the group consisting of nitro, cyano, alkylsulfonyl; sulfamoyl ($-SO_2NR_2$); and sulfonamido ($-NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

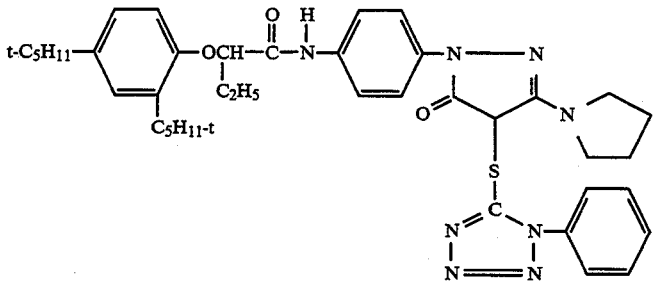

D2

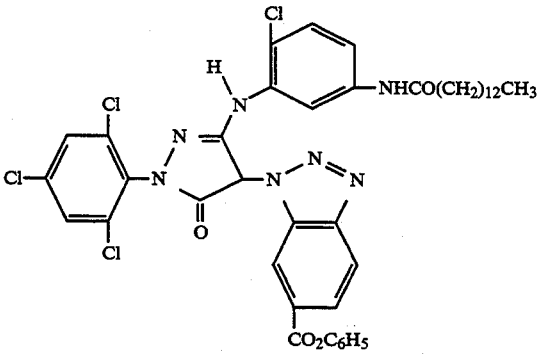

D3

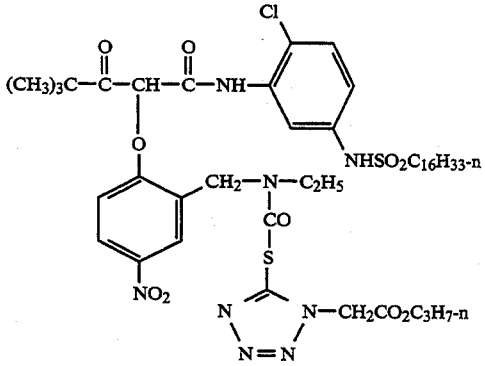

D4

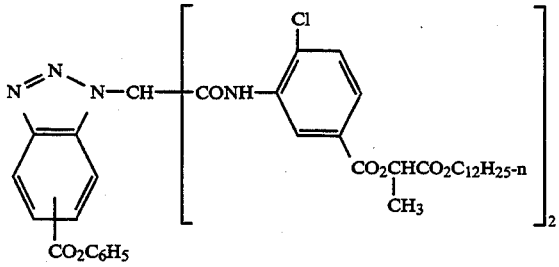

-continued

D5

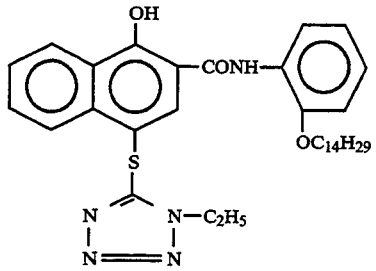

D6

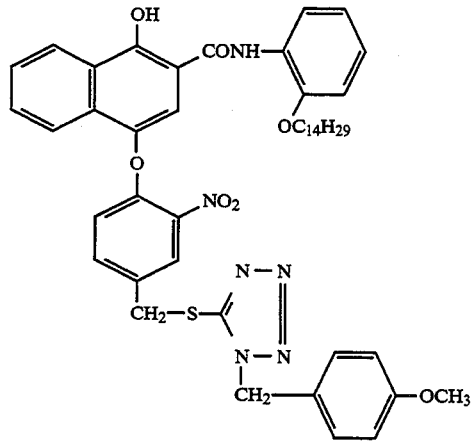

D7

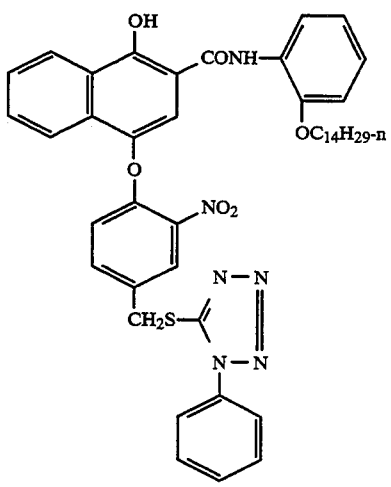

D8

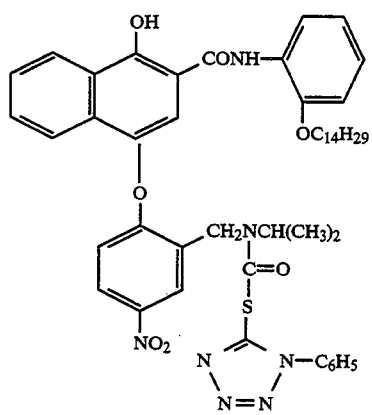

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; with epoxy solvents (EP 0 164 961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 μm (0.5 μm for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in μm and t is the average thickness in μm of the tabular grains.

The average useful ECD of photographic emulsions can range up to about 10 μm, although in practice emulsion ECD's seldom exceed about 4 μm. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ μm) tabular grains. To achieve the lowest levels of granularity it is preferred to that aim tabular grain projected areas be satisfied with ultrathin ($t<0.06$ μm) tabular grains. Tabular grain thicknesses typically range down to about 0.02 μm. However, still lower tabular grain thicknesses are contemplated. For example, Daubendiek et al. U.S. Pat. No. 4,672,027 reports a 3 mole percent iodide tabular grain silver bromoiodide emulsion having a grain thickness of 0.017 μm.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: *Research Disclosure*, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The invention is further illustrated by the following Examples, without being limited thereby:

Examples 1–4 and Comparisons 1C–4C

Tests were conducted to compare the composition of the invention to similar compositions as shown in Table I.

Single layer photographic elements were prepared by coating a cellulose acetate-butyrate film support (with a rem-jet antihalation backing) with a photosensitive layer containing a silver bromoiodide emulsion at 1.08 g/m$^2$ gelatin at 3.8 g/m$^2$, an image coupler dispersed in the coupler/addenda as described in Table I at 0.54 mmoles/m$^2$. The photosensitive layer was overcoated with a layer containing gelatin at 2.7 g/m$^2$, and bisvinylsulfonyl methyl ether hardener at 1.75 weight percent based on total gel.

Samples of each element were exposed imagewise through a stepped density test object and processed at 37 degrees C. employing a color developing solution, then either (1) stopped with a low pH bath, bleached, fixed, washed and dried to produce stepped colored images or (2) bleached with a pH 6 bath to simulate developer carry-over in a seasoned bath, fixed, washed and dried.

Continued coupling was measured in two ways. With the ± stop, the density of samples was compared to determine the additional density obtained from continued coupling when no acid stop is used between the development and bleach steps compared to the use of a stop bath. A similar comparison is made in the right column of Table I but the bleach pH is raised to 6 to simulate the carry over of alkaline developer into a seasoned bleach bath. This has the effect of worsening the continued coupling.

TABLE I

| | | | | | | Continued Coupling | |
|---|---|---|---|---|---|---|---|
| | | | | | | Continued Coupling Delta Dmin | |
| Test | Type | Coupler (C) | Solvent (S) | Amine (A) | Wt Ratio C:S:A | +/− Stop | +/− Stop & pH6 Bleach |
| Ex 1 | Inv. | M3 | C4 | A1 | 1:0.7:0.16* | .069 | .213 |
| Comp 1C | Check | M3 | C4 | — | 1:0.7:0 | .247 | .583 |
| Ex 2 | Inv | M20 | C4 | A1 | As in Ex. 1 | .031 | .145 |
| Comp 2C | Check | M20 | C4 | — | As in 1C | .066 | .297 |
| Ex 3 | Inv | M3 | C1 | A1 | As in Ex. 1 | .095 | .281 |
| Comp 3C | Check | M3 | C1 | — | As in 1C | .361 | .792 |
| Ex 4 | Inv | M20 | C1 | A1 | As in Ex. 1 | .039 | .172 |
| Comp 4C | Check | M20 | C1 | — | As in 1C | .099 | .418 |

*Also contains minor quantities of trihexylphosphate (0.10) and tricresylphosphate (.04)

Each of the Examples 1–4 contained approximately 83% phenol as wt % of total solvent employed and contained 0.16 wt parts of amine A1 per part coupler. Table I shows that the amine is essential to prevent excessive continued coupling. In each Example, the amount of continued coupling is at least double in the absence of the amine, and this effect is not neutralized by the presence of the hydrogen bond donating phenol.

Examples 5–7

Tests were conducted to compare the effect of the composition of the invention in the presence of a development inhibitor to the effect of the indicated check composition containing no phenolic solvent.

Single layer photographic elements were prepared by coating a cellulose acetate-butyrate film support (with a rem-jet antihalation backing) with a photosensitive layer containing a silver bromoiodide emulsion at 1.08 g/m$^2$, gelatin at 3.77 g/m$^2$,and an image coupler dispersed in the coupler/addenda as indicated at 0.52 mmoles/m$^2$. A DIR (D1) separately dispersed at twice its weight in tricresylphosphate, was added at a molar ratio of image coupler:DIR of 12:1. The photosensitive layer was overcoated with a layer containing gelatin at 2.69 g/m$^2$ and bisvinylsulfonyl methyl ether hardener at 1.75 weight percent based on total gel.

Samples of each element were exposed imagewise through a stepped density test object and subjected to the KODAK FLEXICOLOR (C41) process (with a 1% sulfuric acid stop bath) as described in *British Journal of Photography Annual*, 1988, pp. 196–198.

Gamma is recorded as the maximum slope between any two exposure steps and is indicative of activity or contrast.

For the mixed phenolic-phosphate solvent Example 5, the image coupler was dispersed at a weight ratio of 1 part coupler:0.7 p-dodecylphenol:0.16 amine:0.10 trihexylphosphate:0.04 tricresylphosphate. For the comparisons 5C containing no phenol solvent, the ratio was 1 part coupler:0.16 amine:0.74 tricresylphosphate:0.10 trihexylphosphate.

TABLE II

| Test | Type | Coupler (C) | Solvent (S) | Amine (A) | Ratio C:S:A | Loss of Contrast Due to DIR Presence Gamma % |
|---|---|---|---|---|---|---|
| | | | Inhibition Sensitivity | | | |
| Ex 5 | Inv. | M3 | C4 | A1 | 1:0.7:0.16* | −32.4% |
| Comp 5C | Check | M3 | TCP** | A1 | 1:0.7:0.16* | −43.7% |
| Ex 6 | Inv | M3 | C4 | — | 1:1 | −26.8% |
| Comp 6C | Check | M3 | TCP** | — | 1:1 | −42.6% |
| Ex 7 | Inv | M6 | C4 | — | 1:1 | −35.8% |
| Comp 7C | Check | M6 | TCP** | — | 1:1 | −45.8% |

*Also contains trihexylphosphate (0.10) and tricresylphosphate (0.04)
**Tricresylphosphate The results of Examples 5 through 7 show that when a conventional phosphate solvent is used in place of phenolic solvent of the invention, a much greater loss of contrast is realized in the presence of a development inhibiting material. Since such inhibitors are essential to obtaining sharpness and accurate color rendition, and since inhibitors are also unintentionally formed during the photographic process, an important advantage is imparted by the phenolic coupler solvent. Moreover, the presence of the hydrogen bond accepting amine does not neutralize the effect of the phenol. Similar results were obtained with other DIR's.

What is claimed is:

1. A color photographic material, comprising a support bearing a silver halide emulsion and associated therewith a coupler composition comprising (a) a two-equivalent 3-anilino pyrazolone magneta dye-forming coupler, (b) a phenolic coupler solvent and (c) at least one compound selected from anilines and amines.

2. A color photographic material as defined by claim 1, wherein the two-equivalent pyrazolone magneta dye-forming coupler is of the formula:

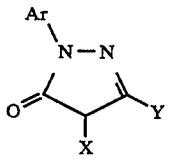

(I)

wherein:

Ar is selected from the group consisting of unsubstituted aryl groups, substituted aryl groups and substituted pyridyl groups, the substituents being selected from the group consisting of halogen atoms and cyano, alkysulfonyl, arylsulfonyl, sulfamoyl, sulfamido, carbamoyl, carbonamido, alkoxy, acyloxy, aryloxy, alkoxycarbonyl, aryloxycarbonyl, ureido, nitro, alkyl and trifluoromethyl groups;

Y is an anilino group substituted with one or more substituents selected from the group consisting of halogen atoms, and alkyl, aryl, alkoxy, aryloxy, carbonamido, carbamoyl, sulfonamido, sulfamoyl, alkylsulfoxyl, arylsulfoxyl, alkysulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, and groups which form a link to a polymeric chain, and wherein Y contains at least 6 carbon atoms; and X is a coupling-off group selected from the group consisting of halogen, alkoxy, aryloxy, alkylthio, arylthio, acyloxy, sulfonamido, sulfonyloxy, carbonamido, arylazo, nitrogen-containing heterocyclic and imido groups.

3. A color photographic material as defined by claim 2, wherein Ar is of the formula:

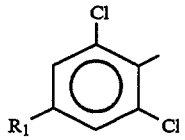

(II)

wherein $R_1$ is selected from the group consisting of halogen, cyano, alkylsulfonyl, arylsulfonyl, sulfamoyl, sulfonamido, carbamoyl, carbonamido, ureido, alkoxycarbonyl, aryloxycarbonyl, acyloxy, alkoxy, aryloxy, nitro and trifluoromethyl groups.

4. A color photographic material as defined by claim 2, wherein Y is of the formula:

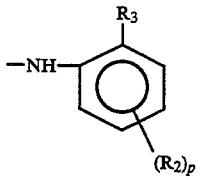

(III)

wherein p is from zero to 2 and each $R_2$ is in a meta or para position with respect to $R_3$;

each $R_2$ is individually selected from the group consisting of halogen, alkyl, alkoxy, aryloxy, carbonamido, carbamoyl, sulfonamido, sulfamoyl, alkylsulfoxyl, arylsulfoxyl, alkylsulfonyl, arylsulfonyl, alkoxycarbonyl, aryloxycarbonyl, acyloxy, ureido, imido, carbamate, heterocyclic, cyano, nitro, acyl, trifluoromethyl, alklythio and carboxyl groups, and;

$R_3$ is selected from the group consisting of hydrogen, halogen, alkyl, alkoxy, aryloxy, alkylthio, carbonamido, carbamoyl, sulfonamido, sulfamoyl, alkylsulfonyl, arylsulfonyl, alkoxycarbonyl, acyloxy, acyl, cyano, nitro and trifluoromethyl groups.

5. A color photographic material as defined by claim 2, wherein X is of the formula:

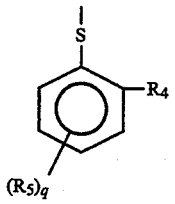

(IV)

wherein $R_4$ and $R_5$ are individually selected from the group consisting of hydrogen, halogen, alkyl, alkoxy, aryloxy, carbonamido, ureido, carbamate, sulfonamido, carbamoyl, sulfamoyl, acyloxy, alkoxycarbonyl, aryloxycarbonyl, amino and carboxyl groups, and wherein q is 0, 1 or 2 and $R_5$ may be in the meta or para position with respect to the sulfur atom.

6. A color photographic material as defined by claim 5, wherein $R_4$ contains at least one carbon atom, and further wherein the total number of carbon atoms in $R_4$ and $R_5$ is from about 5 to about 25.

7. A color photographic material as defined by claim 1, wherein the phenolic coupler solvent is of the formula:

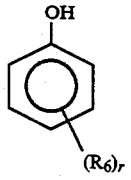

(V)

wherein each $R_6$ is individually selected from the group consisting of straight chain, branched and cyclic alkyl groups and straight chain, branched and cyclic alkoxy groups, and straight chain, branched and cyclic alkoxy carbonyl groups, all of such groups being substituted or unsubstituted, wherein r is 1 to 5.

8. A color photographic material as defined by claim 7, wherein at least one $R_6$ is an unbranched alkyl group.

9. A color photographic material as defined by claim 7, containing at least 8 carbon atoms in the combined $R_6$ groups.

10. A color photographic material as defined by claim 9, wherein r is 1 and $R_6$ is p-dodecyl.

11. A color photographic material as defined by claim 9, wherein r is 2 and each $R_6$ is pentyl.

12. A color photographic material as defined by claim 1, including an aniline compound of the formula:

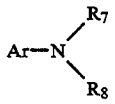

(VI)

wherein $R_7$ is selected from the group consisting of alkyl, aralkyl, cycloalkyl and alkenyl groups and said groups including one or more substituents selected from acyloxy, alkoxycarbonyl, aryloxycarbonyl, acylamino, carbamoyl, alkoxy and aryloxy groups, $R_8$ is selected from hydrogen and the group from which $R_7$ may be selected; and Ar is selected from the group consisting of phenyl and phenyl including one or more substituents selected from alkyl, aralkyl, alkenyl, cycloalkyl, alkoxy, aryloxy, phenyl and acylamino groups; and wherein $R_7$ and $R_8$ and Ar combined contain at least 12 carbon atoms.

13. A color photographic material as defined by claim 12, wherein $R_7$ and $R_8$ are individually selected from branched and straight chain alkyl groups.

14. A color photographic material as defined by claim 12, wherein Ar is phenyl including at least one alkyl or alkoxy substituent.

15. A color photographic material as defined by claim 14, wherein Ar comprises phenyl with an alkoxy group substituent which is ortho to the N atom.

16. A color photographic material as defined by claim 12 wherein $R_7$, $R_8$ and Ar combined contain from 20 to about 40 carbon atoms.

17. A color photographic material as defined by claim 1, including an amine compound of the formula:

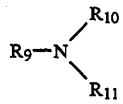

(VII)

wherein $R_9$ is selected from the group consisting of alkyl, cycloalkyl and alkenyl groups and said groups including one or more substituents selected from halogens and alkyl, aralkyl, acyloxy, alkoxycarbonyl, aryloxycarbonyl, acylamino, carbamoyl, alkoxy, aryloxy, hydroxy, alkylsulfonyl, arylsulfonyl, alkylsulfoxyl, arylsulfoxyl, phosphonyl and heterocyclic groups; and $R_{10}$ and $R_{11}$ are individually selected from hydrogen and the group from which $R_9$ may be selected; and wherein $R_9$, $R_{10}$ and $R_{11}$ combined contain at least 12 carbon atoms.

18. A color photographic material as defined by claim 17, wherein $R_9$ and $R_{10}$ or $R_{10}$ and $R_{11}$ form a ring.

19. A color photographic material as defined by claim 17, wherein at least one of $R_9$, $R_{10}$ and $R_{11}$ is an alkyl group.

20. A color photographic material as defined by claim 17, wherein $R_9$, $R_{10}$ and $R_{11}$ combined contain from about 15 to about 40 carbon atoms.

21. A color photographic material as defined by claim 1, wherein the phenolic compound is present in the coupler composition in an amount sufficient to improve the inhibition sensitivity of the pyrazolone magenta dye-forming coupler.

22. A color photographic material as defined by claim 1, wherein the coupler composition comprises the pyrazolone magenta dye-forming coupler and the phenolic compound in a weight ratio of from about 1:0.1 to about 1:10.

23. A color photographic material as defined by claim 1, wherein the aniline or amine compound is included in the coupler composition in an amount sufficient to reduce continued coupling of the pyrazolone magenta dye-forming coupler during a bleach step in a color photographic process.

24. A color photographic material as defined by claim 1, wherein the coupler composition comprises the pyrazolone magenta dye-forming coupler and the aniline or amine compound in a weight ratio of from about 1:0.03 to about 1:3.

25. The material of claim 1 wherein the coupler composition additionally comprises a second coupler solvent.

26. The material of claim 25 wherein the second solvent is a phosphate.

27. The material of claim 25 wherein the second solvent is tricresyl phosphate.

28. The material of claim 25 wherein the phenolic solvent is at least 10 wt % of the total coupler solvent.

29. The material of claim 1 wherein said silver halide emulsion having associated therewith the coupler composition has associated therewith a development inhibitor releasing coupler (DIR) comprising a coupler moiety and an inhibitor moiety.

30. The material of claim 29 wherein said DIR contains an inhibitor moiety selected from the group consisting of a tetrazole, a mercaptotetrazole and a benzotriazole.

31. The material of claim 1 additionally comprising a film containing magnetic particles.

32. A method of forming a color photographic image, comprising (A) imagewise exposing a photographic layer, and (B) developing the exposed image, wherein the photographic layer comprises (a) a two-equivalent 3-anilino pyrazolone magenta dye-forming copier, (b) a phenolic coupler solvent compound, and (c) at least one compound selected from the group consisting of anilines and amines.

33. The material of claim 29 wherein the DIR is of the time-delayed type which also include a timing moiety which produces a delayed release of inhibitor.

34. The material of claim 33 wherein the timing moiety is selected from the group consisting of:

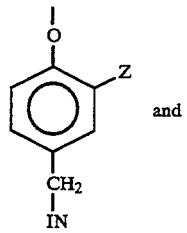

and

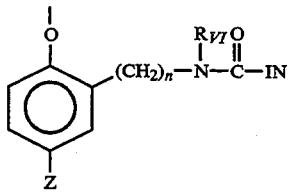

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups and the oxygen atom of each timing group is bonded to the coupling-off position of the respective coupler moiety of the coupler.

35. The material of claim 29 wherein the DIR is one containing an inhibitor moiety selected from the group consisting of oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles and benzisodiazoles.

36. The material of claim 29 wherein the DIR is selected from the group consisting of:

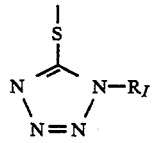

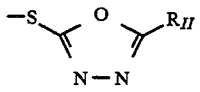

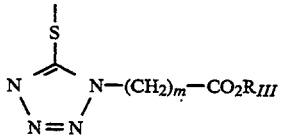

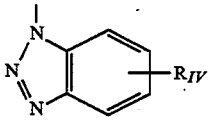

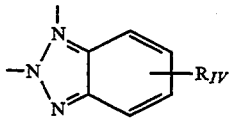

wherein $R_I$ is selected from the group consisting of straight and branched alkyls of from 1 to about 8 carbon atoms, benzyl and phenyl groups and said groups containing at least one alkoxy substituent; $R_{II}$ is selected from $R_I$ and $—SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, $—COOR_V$ and $—NHCOOR_V$ wherein $R_V$ is selected from substituted and unsubstituted alkyl and aryl groups.

37. The material of claim 29 wherein the DIR is selected from the group consisting of:

D1
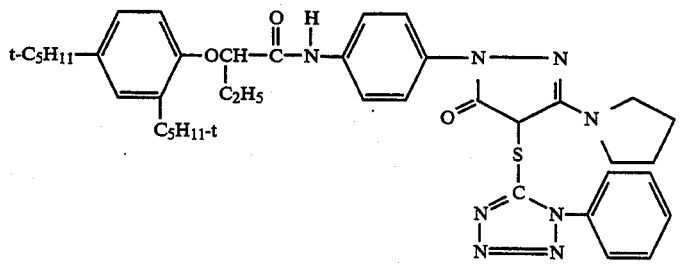
D2
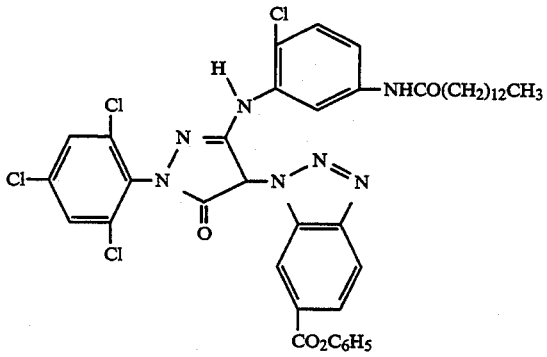
D3
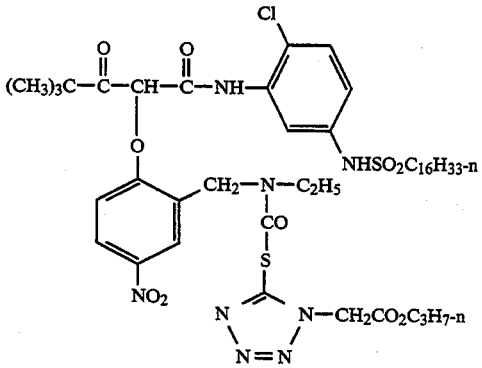
D4
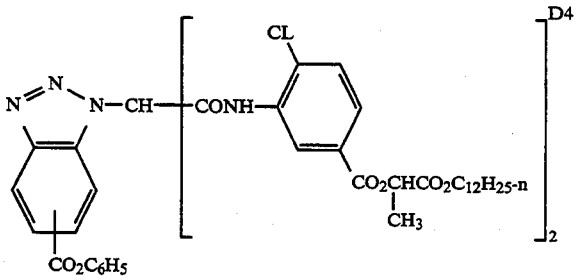
D5
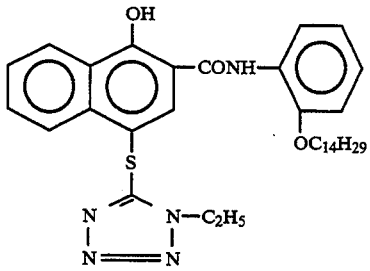
D6
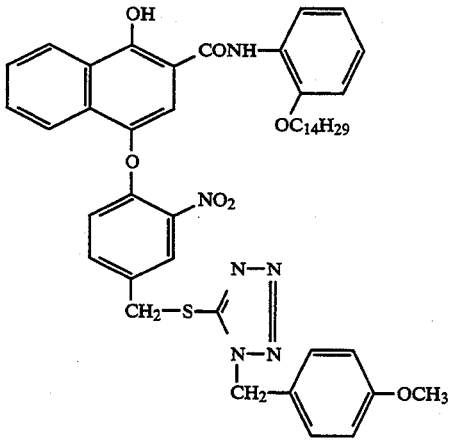
D7
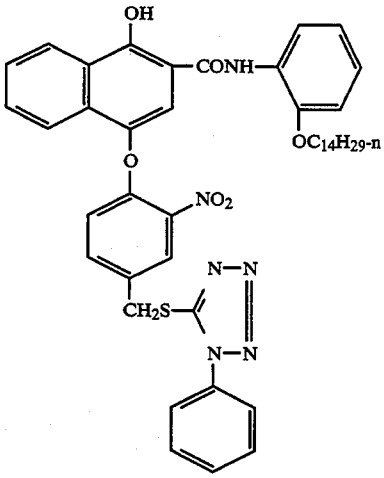

-continued

D8

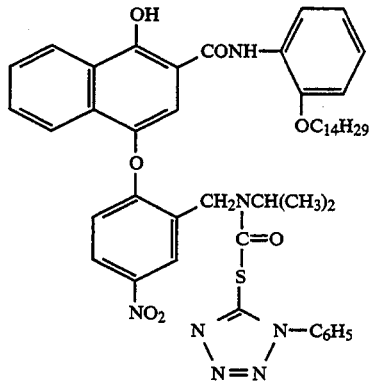

38. The material of claim 29 wherein the material comprises a coupler moiety having the inhibitor moiety attached thereto wherein the coupler moiety is the same or a different color from that of the imaging layer with which it is associated.

39. The material of claim 29 wherein the material comprises a coupler moiety having the inhibitor moiety attached thereto wherein the coupler moiety forms colorless product or products that wash out of the material during processing.

* * * * *